US009469928B2

(12) United States Patent
Kim et al.

(10) Patent No.: US 9,469,928 B2
(45) Date of Patent: Oct. 18, 2016

(54) WASHING METHOD FOR WASHING MACHINE

(75) Inventors: Young Jong Kim, Changwon-si (KR); Sang Jun Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1055 days.

(21) Appl. No.: 12/958,812

(22) Filed: Dec. 2, 2010

(65) Prior Publication Data

US 2011/0131734 A1 Jun. 9, 2011

(30) Foreign Application Priority Data

Dec. 4, 2009 (KR) ..... 10-2009-0119997

(51) Int. Cl.

| | |
|---|---|
| ***D06F 33/02*** | (2006.01) |
| ***D06F 37/40*** | (2006.01) |
| ***D06F 35/00*** | (2006.01) |
| ***D06F 37/30*** | (2006.01) |

(52) U.S. Cl.

CPC ..... *D06F 35/006* (2013.01); *D06F 37/304* (2013.01); *D06F 37/40* (2013.01)

(58) Field of Classification Search

CPC .... D06F 37/304; D06F 35/006; D06F 21/06; D06F 13/02; D06F 37/40

See application file for complete search history.

(56) References Cited

U.S. PATENT DOCUMENTS

| | | | | |
|---|---|---|---|---|
| 4,765,160 | A * | 8/1988 | Yamamoto | D06F 33/02 68/12.03 |
| 5,373,714 | A * | 12/1994 | Wada | 68/12.02 |
| 6,134,925 | A | 10/2000 | Fujii et al. | |
| 6,415,469 | B1 * | 7/2002 | Diaz Fernandez et al. | 8/158 |
| 2003/0208852 | A1 * | 11/2003 | Hardaway | D06F 35/006 8/158 |
| 2003/0208855 | A1 * | 11/2003 | McAllister | D06F 35/006 8/159 |
| 2003/0217417 | A1 * | 11/2003 | Jung | D06F 35/00 8/158 |
| 2004/0168482 | A1 * | 9/2004 | Lyu et al. | 68/13 R |
| 2005/0217036 | A1 * | 10/2005 | Park | 8/158 |
| 2006/0016021 | A1 * | 1/2006 | Kim | D06F 35/006 8/158 |
| 2006/0087263 | A1 * | 4/2006 | Sa et al. | 318/66 |
| 2006/0248658 | A1 * | 11/2006 | Ha | D06F 35/006 8/147 |
| 2007/0107474 | A1 | 5/2007 | Jun | |
| 2008/0120789 | A1 * | 5/2008 | Ashrafzadeh et al. | 8/159 |

FOREIGN PATENT DOCUMENTS

| | | | |
|---|---|---|---|
| KR | 10-2003-0049821 | A | 6/2003 |
| KR | 10-2006-0004499 | A | 1/2006 |
| KR | 10-2006-0036725 | A | 5/2008 |

* cited by examiner

*Primary Examiner* — Michael Kornakov
*Assistant Examiner* — Marc Lorenzi
(74) *Attorney, Agent, or Firm* — Birch, Stewart, Kolasch & Birch, LLP

(57) ABSTRACT

Provided is a washing method of a washing machine including an outer tub for receiving washing water, an inner tub rotatably provided in the outer tub to receive laundry, a pulsator rotatably provided in the inner tub, and a motor providing driving force to rotate at least one of the inner tub and the pulsator. In the washing method, a first centrifugal circulation water stream is formed by rotating the inner tub such that the washing water rises along a space between the outer and inner tubs and falls into the inner tub. An agitating water stream is formed by rotating the pulsator rotating the washing water. Here, the forming of the agitating water stream includes forming a first agitating water stream by controlling the motor with a first net acting ratio, and forming a second agitating water stream by controlling the motor with a second net acting ratio lower than the first net acting ratio.

8 Claims, 8 Drawing Sheets

WASHING METHOD FOR WASHING MACHINE

CROSS-REFERENCE TO RELATED APPLICATION

This application claims priority from Korean Patent Application No. 10-2009-0119997 filed on Dec. 4, 2009 in the Korean Intellectual Property Office, the disclosure of which is incorporated herein by reference in its entirety.

BACKGROUND OF THE INVENTION

1. Field of the Invention

The present invention relates to a washing method, and more particularly, to a washing method that can reduce vibration, noise, and heat that are generated during the operation of a washing machine.

2. Description of the Related Art

In general, a washing machine is an apparatus that removes contaminants from clothing, bed linen, etc. (hereinafter, referred to as 'laundry') using a chemical action between water and detergent, and a mechanical action such as a frictional force between water and laundry.

The washing machine is designed to clean the laundry by sequentially performing a wash cycle, a rinse cycle, and a spin cycle. Those cycles may be partially performed according to a user's selection. Also, washing may be achieved through various courses that are set according to the types of the laundry.

A typical washing machine has a limitation in that the laundry loaded in a washing tub may not be evenly distributed in the washing tub due to tangles of the laundry, and therefore vibration and noise may be generated.

The rotation of a motor in the typical washing machine is controlled by a driver that provides a driving signal to the motor. The driver drives the motor by applying a driving signal of a high current to the motor. Therefore, when the motor is continuously driven, heat generation may be proportional to the driving time of the motor. Accordingly, when the laundry is treated by continuously driving the motor, the driver for driving the motor may be overheated and its stability may be affected. For this reason, a method for minimizing heat generation of the driver for motor is required.

SUMMARY OF THE INVENTION

An object of the present invention is to provide a washing method that can reduce vibration, noise, and heat that are generated during the operation of a washing machine.

According to an aspect of the present invention, there is provided a washing method of a washing machine including an outer tube for receiving washing water, an inner tube that is rotatably provided in the outer tub to receive laundry, a pulsator rotatably provided in the inner tub, and a motor that provides driving force to rotate at least one of the inner tub and the pulsator, the washing method including: forming a first centrifugal circulation water stream by rotating the inner tub such that the washing water rises along a space between the outer and inner tubs and falls into the inner tub; and forming an agitating water stream by rotating the pulsator, wherein the forming of the agitating water stream includes: forming a first agitating water stream by controlling the motor with a first net acting ratio; and forming a second agitating water stream by controlling the motor with a second net acting ratio lower than the first net acting ratio, following the forming of the first agitating water stream.

The forming of the first agitating water stream may be repeatedly performed and the forming of the second agitating water stream is performed between the first agitating water stream forming processes.

The first net acting ratio may be about 1.

The washing method may further include, after the forming of the agitating water stream, disentangling the laundry by alternately rotating the pulsator clockwise and counterclockwise so that the laundry in the inner tub can be evenly distributed. At this point, a RPM of the motor in the disentangling of the laundry may be lower than that of the motor in the forming of the agitating water stream.

Meanwhile, the washing method may further include, following the disentangling of the laundry, forming a second centrifugal circulation water stream by rotating the inner tub such that the washing water in the outer tub rises along the space between the outer and inner tubs and falls into the inner tub. In addition, the washing method may further include, following the forming of the second centrifugal circulation water stream, spinning the inner tub to remove the water out of the laundry by driving the motor with a RPM higher than that in the forming of the agitating water stream.

Meanwhile, in the forming of the agitating water stream, the motor may be controlled such that the pulsator alternately rotates clockwise and counterclockwise.

In addition, in the forming of the centrifugal circulation water stream, the inner and pulsator may integrally rotate with each other.

According to another aspect of the present invention, there is provided a washing method of a washing machine including an outer tube for receiving washing water, an inner tube that is rotatably provided in the outer tub to receive laundry, a pulsator rotatably provided in the inner tub, and a motor that provides driving force to rotate at least one of the inner tub and the pulsator, the washing method including: performing a high concentration washing process by supplying water in which detergent is dissolved to a predetermined level and driving at least one of the inner tub and the pulsator; and performing a dilution washing process by additionally supplying washing water and driving at least one of the inner tub and the pulsator, wherein the performing of the high concentration washing process includes: forming a first centrifugal circulation water stream by rotating the inner tub such that the washing water rises along a space between the outer and inner tubs and falls into the inner tub; and forming an agitating water stream by rotating the pulsator, wherein the forming of the agitating water stream includes: forming a first agitating water stream by controlling the motor with a first net acting ratio; and forming a second agitating water stream by controlling the motor with a second net acting ratio lower than the first net acting ratio, following the forming of the first agitating water stream, and wherein the dilution washing process includes: forming a third agitating water stream by rotating the pulsator such that the washing water in the inner tub can be agitated, wherein a net acting ratio in the forming of the third agitating water stream is different from those in the forming of the first and second agitating water streams.

The forming of the first agitating water stream may be repeatedly performed and the forming of the second agitating water stream is performed between the first agitating water stream forming processes.

The first net acting ratio may be about 1.

The performing of the high concentration washing process may further includes, after the forming of the agitating water stream, disentangling the laundry by alternately rotating the pulsator clockwise and counterclockwise so that the laundry in the inner tub can be evenly distributed. At this point, a RPM of the motor in the disentangling of the laundry may be lower than that of the motor in the forming of the agitating water stream. In addition, the washing method may further includes, following the disentangling of the laundry, forming a second centrifugal circulation water stream by rotating the inner tub such that the washing water in the outer tub rises along the space between the outer and inner tubs and falls into the inner tub.

The performing of the dilution washing process may further include the forming of the first agitating water stream, wherein the forming of the third agitating water stream may follows the forming of the first agitating water stream.

A net acting ratio in the forming of the third agitating water stream may be less than the first net acting ratio.

A net acting ratio in the forming of the third agitating water stream may be a value between the first and second net acting ratios.

BRIEF DESCRIPTION OF THE DRAWINGS

The features and advantages of the present invention will become more apparent from reading the Detailed Description of the Invention which makes reference to the attached drawings in which.

DETAILED DESCRIPTION OF THE INVENTION

Figure 1:
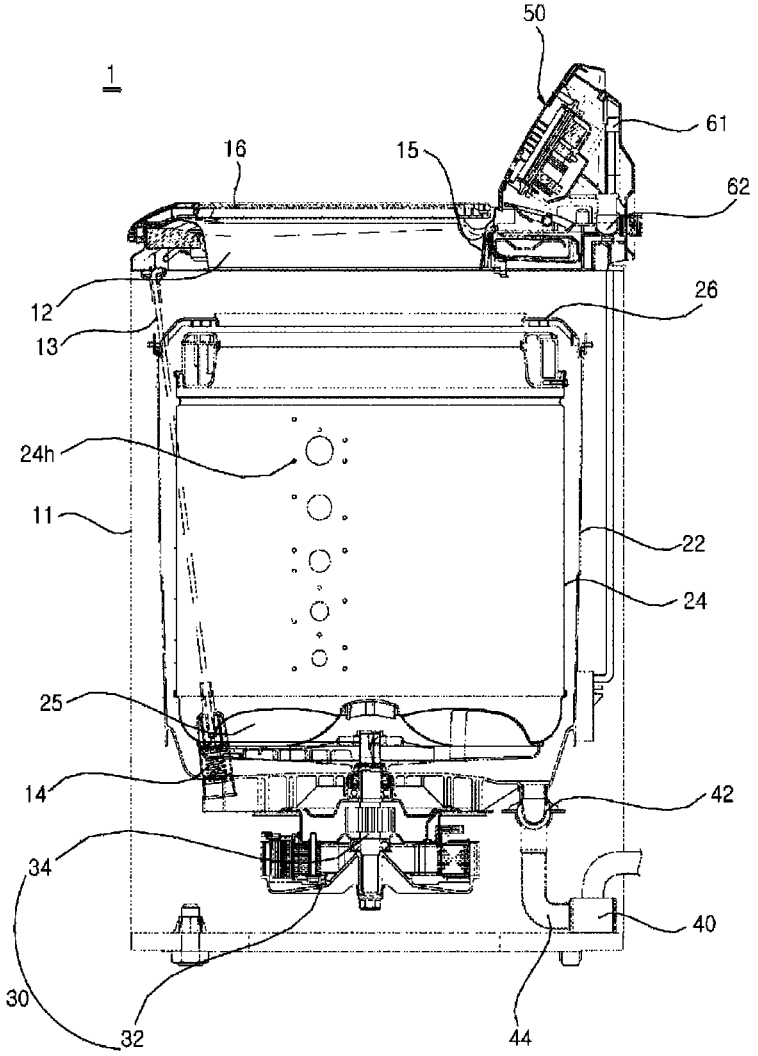
FIG. 1 is a side sectional view of a washing machine according to an embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Like reference numerals in the drawings denote like elements.

Figure 2:
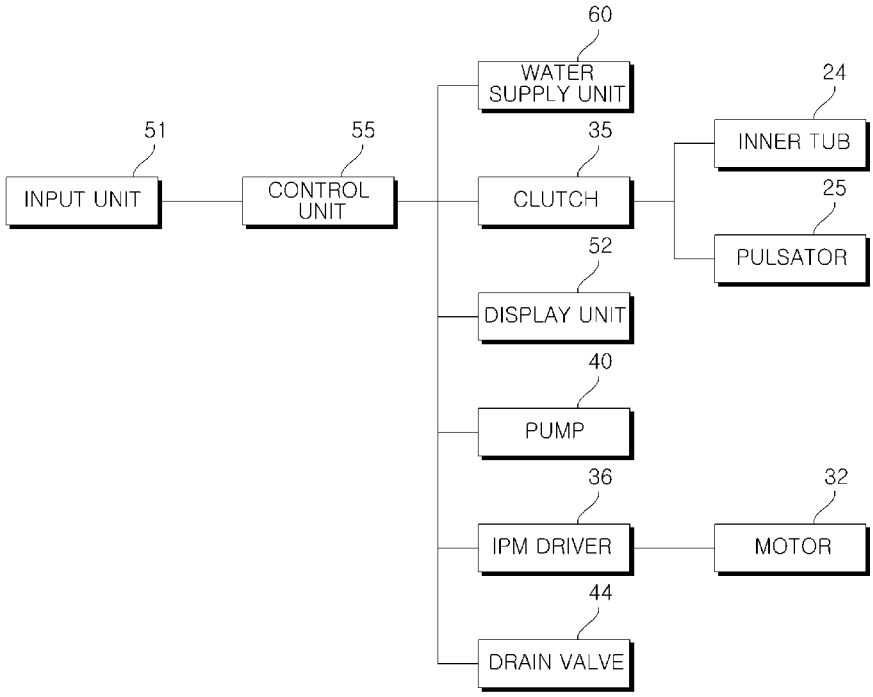
FIG. 2 is a block diagram illustrating a control relation between major components of the washing machine of FIG. 1.

FIG. 1 is a side sectional view of a washing machine according to an embodiment of the present invention and FIG. 2 is a block diagram illustrating a control relationship between major components of the washing machine of FIG. 1.

Referring to FIGS. 1 and 2, a washing machine 1 according to an embodiment of the present invention includes a cabinet 1 having an opened top, a top cover 12 coupled to a top portion of the cabinet 11 and provided with an opening through which laundry is loaded and unloaded, a door 16 that is rotatably coupled to the top cover 12 to open and close the opening of the top cover 12, an outer tub 22 that is hung on the top cover 12 by a supporting member 13 and storing washing water, a damper 14 that connects the supporting member 13 to the outer tub 22 and absorbs vibration that is generated during the operation of the washing machine 1, an outer tub cover 26 that is coupled to a top portion of the outer tub 22 and is provided with a central opening through which the laundry and/or washing water pass, an inner tub 24 that is rotatably provided in the outer tub 22 to receive the laundry, a pulsator 25 that is rotatably provided in the inner tub 24 to agitate the washing water, and a driving unit 30 for providing driving force to the inner tub 24 and/or the pulsator 25.

The driving unit 30 includes a motor 32 generating the rotational force, a rotational shaft 34 rotating by the motor 32, a clutch 35 that transmits the rotational force such that the inner tub 24 and/or the pulsator 25 rotate by the rotational shaft 34, and a driver that controls rotation of the motor 32 by applying a driving signal to the motor 32.

The driver applies the driving signal formed with a predetermined pattern to the motor to rotate the motor 32 in accordance with the driving signal. The driving signal may be formed with a variety of patterns including an On-time section at which the current is applied to the motor 32 and an Off-time section at which no current is applied to the motor 32.

A power metal-oxide-semiconductor field-effect transistor (MOSFET) that is called a intelligent power module (IPM) for controlling electric power, a driving circuit of a power unit such as an insulated gate bipolar transistor (IGBT), or a power module having a self-protecting function is used as the driver. Hereinafter, the embodiment will be described as the driver is the IPM.

By the manipulation of the clutch 35, one of the inner tub 24 and the pulsator 25 may be selectively rotated or the inner tub 24 and the pulsator 25 may be simultaneously rotated.

A detergent box 15 for storing a variety of washing aids such as washing detergent, rinsing softener, a bleaching agent, and/or the like is detachably mounted on the top cover 12. A water supply passage 61 is connected to an outer water source such as a faucet to supply the water to the inner and outer tubs 24 and 22.

A water supply unit 60 is for directing the washing water to the detergent box. The water supply unit 60 includes the water supply passage 61 and a water supply valve 62 provided on the water supply passage 61.

The washing machine 1 further includes a drain passage 44 for draining the washing water filled in the outer tub 22 to an external side, a drain valve 42 provided on the drain passage 44, and a drain pump 40. The inner tub 24 is provided with a plurality of through holes **24*h* through which the washing water passes between the outer and inner tubs 22 and 24**.

Meanwhile, a control panel 50 for providing a user interface is provided on the top cover 12. The control panel 50 includes an input unit 51 for inputting a variety of control commands and a display unit 52 for displaying an operational state of the washing machine.

The control unit 55 controls operations of the water supply unit 60, clutch 35, display unit 52, pump 40, and/or IPM driver 36 in accordance with the control command input through the input unit 51 or a preset algorithm.

Figure 3:
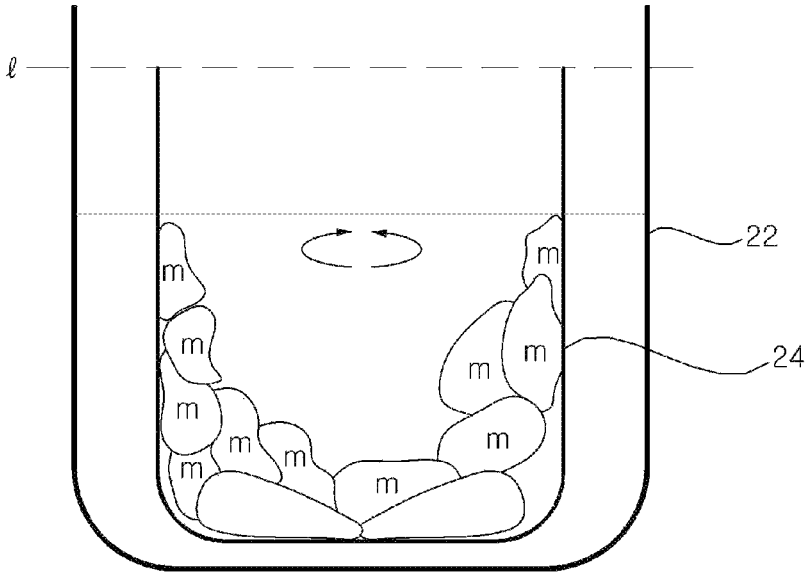
FIG. 3 is a view illustrating an agitating water stream that is formed during the operation of the washing machine according to an embodiment of the present invention.
Figure 4:
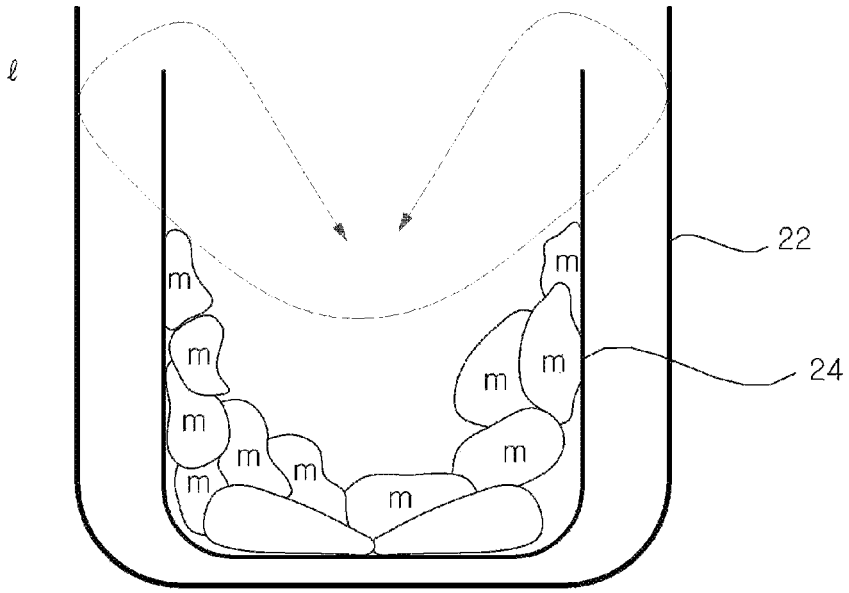
FIG. 4 is a view illustrating a centrifugal circulation water stream that is formed during the operation of the washing machine according to an embodiment of the present invention.

FIG. 3 is a view illustrating agitating water stream that is formed during the operation of the washing machine according to an embodiment of the present invention and FIG. 4 is a view illustrating a centrifugal circulation water stream that is formed during the operation of the washing machine according to an embodiment of the present invention.

Referring to FIG. 3, agitating water stream is generated by agitating rotation (alternative rotation in both directions) of the pulsator 25. The flow direction of the agitation water stream alternately changes clockwise and counterclockwise. Accordingly, the washing water in the inner tub 24 is agitated by inertia that is generated as the flow direction of the agitating water stream changes, thereby improving the washing performance.

The agitating water stream 24 is used to unloose the tangled laundry m and to perform washing using a frictional action between the pulsator 25 and the laundry m.

Referring to FIG. 4, the centrifugal circulation water stream is formed by continuously rotating the inner tub 24 in a direction for a predetermined time. By the centrifugal force that is generated as the inner tub 24 rotates, the laundry m is stuck to an inner surface of the inner tub 24 and the washing water rises between the outer and inner tubs 22 and 24, after which the washing water is directed into the inner tub 24 along a bottom surface of the outer tub cover 26, thereby forming the centrifugal circulation water stream.

The height of the washing water rising between the outer and inner tubs 22 and 24 is determined in accordance with not only an RPM of the inner tub 24 but also an amount of the washing water in the outer tub 22. The amount of the washing water in the outer tub 22 may be determined by a water supplying amount that is differently preset in accordance with an amount of the laundry.

Since the laundry m rotates together with the inner tub 24 as the centrifugal circulation water stream is formed, the location variation of the laundry m is relatively small in the inner tub 24. In addition, by the washing water poured into the inner tub 24, a knocking washing effect can be obtained, thereby Improving the washing performance.

Figure 5:
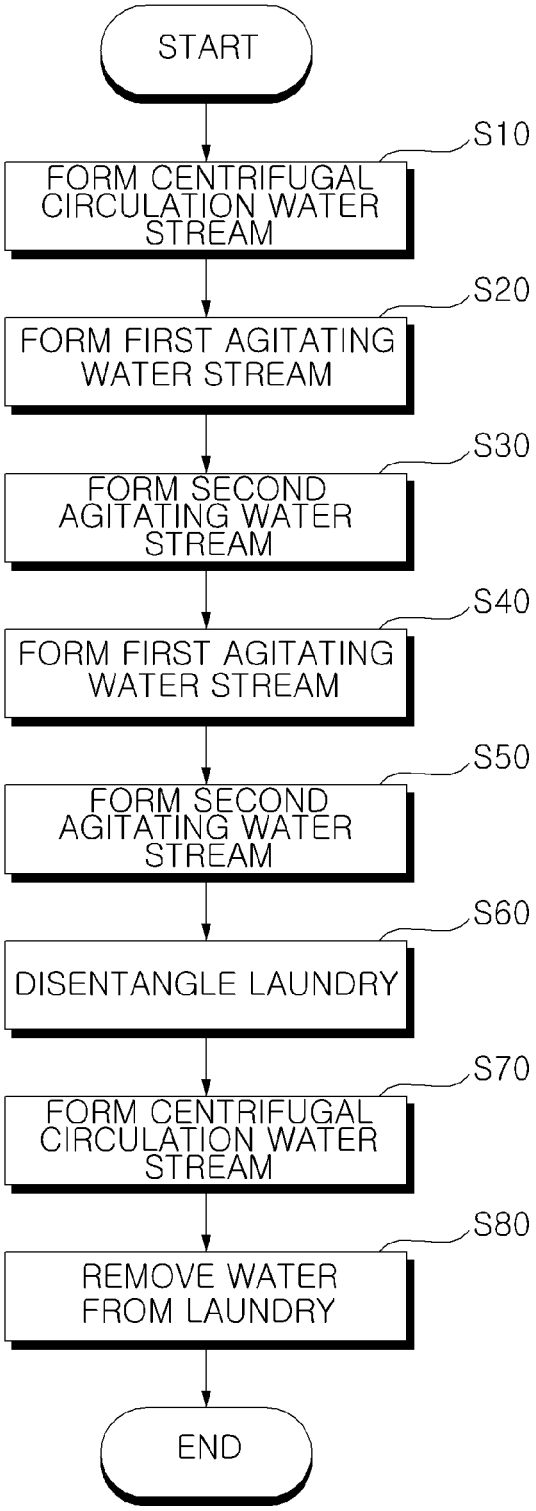
FIG. 5 is a flowchart illustrating a washing method according to an embodiment of the present invention.
Figure 6:
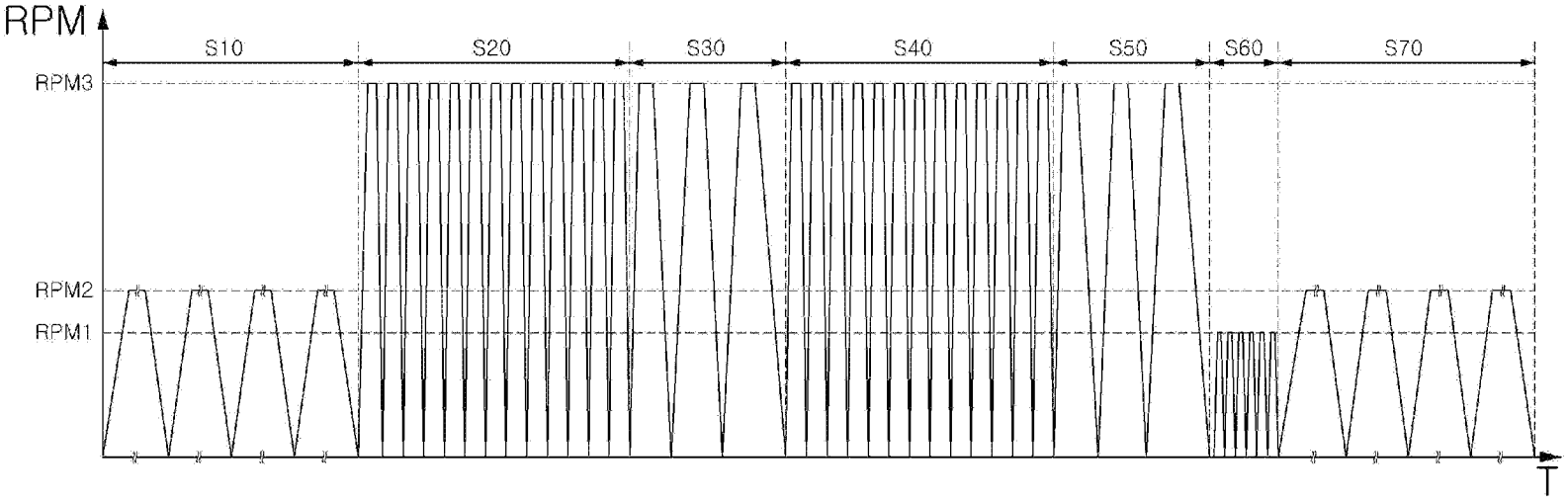
FIG. 6 is a graph illustrating an RPM variation when the washing machine operates in accordance with the washing method illustrated in FIG. 5.
Figure 7:
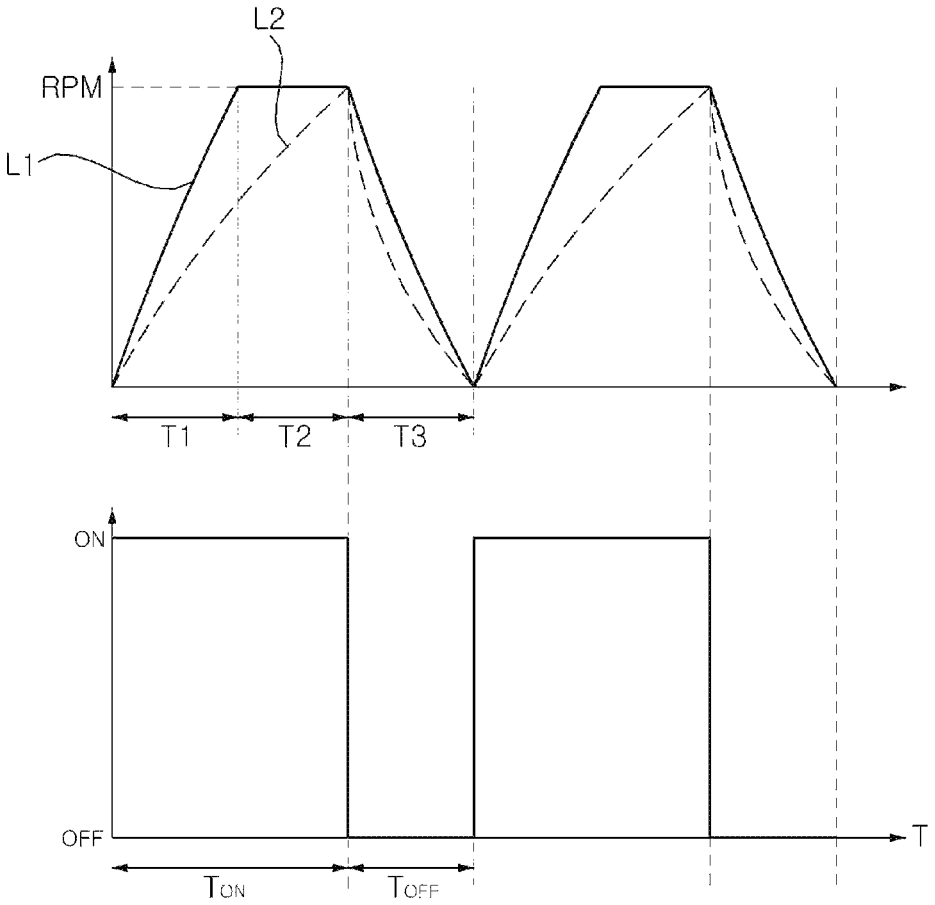
FIG. 7 is a graph illustrating a relation between an RPM variation of a motor and a driving signal applied by an IPM driver.

FIG. 5 is a flowchart illustrating a washing method according to an embodiment of the present invention, FIG. 6 is a graph illustrating an RPM variation when the washing machine operates in accordance with the washing method illustrated in FIG. 5, and FIG. 7 is a graph illustrating a relation between an RPM variation of a motor and a driving signal applied by an IPM driver.

Hereinafter, a washing method according to an embodiment of the present invention will be described with reference to FIGS. 5 to 7.

A washing method according to an embodiment of the present invention includes a process for forming the centrifugal circulation water stream by allowing the washing water in the outer tub 22 to rise along a space between the outer and inner tubs 22 and 24 and to be poured into the inner tub 24 by continuously rotating the inner tub 24 in a direction for a predetermined time at a speed that is set with RPM2 (S10) and a process for forming the agitating water stream in the inner tub 24 by rotating the pulsator 25 at a speed that is set with RPM3 (S20, S30, S40, and S50). At this point, the process for forming the agitating water stream includes a process for forming a first agitating water stream (S20 and S40) and a process for forming a second agitating water stream (S30 and S50). The process for forming the first agitating water stream (S20 and S40) and the process for forming the second agitating water stream (S30 and S50) may be controlled by different net acting ratios.

Here, the net acting ratio is defined by a ratio of an actual motor driving time to a whole time of the driving signal applied to the motor 32 by the IPM driver 36. The driving signal applied to the motor 32 includes the On-time section for which the current is applied to the motor 32 and the Off-time section for which no current is applied to the motor 32.

Therefore, the net acting ratio can be expressed as Equation (1).

$$\text{Net Acting Ratio} = \frac{T_{ON}}{T_{ON} + T_{OFF}} \tag{1}$$

where $T_{ON}$ indicates a signal length of a section for which the current is applied to the motor 32 and $T_{OFF}$ denotes a signal length of a section for which no current is applied to the motor 32.

The control unit 55 controls the IPM driver 36, whereby the net acting ratio of the motor by applying the driving signal having the On-time section and the Off-time section. As a result, the overheating of the motor 32 and the IPM driver 36 can be prevented.

The IPM driver 36 applied the driving signal to the motor 32 in accordance with the control signal of the control unit 55. Therefore, the inner tub 24 and/or the pulsator 25 rotate in accordance with the pattern of the On-time section and Off-time section included in the driving signal. The IPM driver 36 can rotate the motor clockwise or counterclockwise.

When the net acting ratio is about 1, it means that the current is continuously applied to the motor 32. In this case, the motor 32 continuously rotates clockwise or the rotational direction of the motor is changed and the motor keeps rotating in the changed direction. Accordingly, the current is applied to the motor 32 and the IPM driver 36 for the longest time and thus the heat generating amount is biggest.

Since the IPM driver 36 is a semiconductor device or a semiconductor integrated circuit for on/off-controlling the current driving the motor 32, it may be damaged when the temperature thereof increases above 90° C. Therefore, the control unit 55 controls the on/off pattern of the driving signal that is set by the current generated by the IPM driver 36 such that the temperature of the IPM driver 36 is not increased above 90° C.

In the process for forming the agitating water stream (S20, S30, S40, and S50), the IPM driver 36 applies the driving signal having a high current value to the motor 32 to strongly rotate the pulsator 25. Therefore, in order to maintain the temperature of the IPM driver at a proper level, it is preferable to provide a section where the net acting ratio is differently controlled.

The process for forming the agitating water stream includes the process for forming the first agitating water stream (S20 and S40) where the pulsator 25 rotates with the first net acting ratio and the process for forming the second agitating water stream (S30 and S50) where the pulsator 25 rotates with a second net acting ratio that is different from the first net acting ratio.

Hereinafter, it is assumed that the first net acting ratio is about 1 and the second net acting ratio is 0.8. The following will describe with this assumption.

In addition, the graph of FIG. 6 illustrates an RPM of the motor, which varies as time goes on, without considering a rotational direction of the motor 32. The motor 32 can repeatedly rotate in a direction and stop or alternately rotate clockwise and counterclockwise in accordance with the driving signal of the IPM driver. Hereinafter, the alternate rotation of the motor in accordance with the driving signal of the IPM driver 36 will be exemplarily described.

The following will describe a rotational aspect of the motor 32 in accordance with a pattern of the driving signal applied from the IPM driver 36 to the motor 32 with reference to FIG. 7.

The driving signal generated by the IPM driver 36 has a pattern where the On-time section Ton and the Off-time section Toff are alternately formed as described above. In the On-time section Ton where the current is applied to the motor 32, the RPM of the motor is gradually increased until the RPM reaches a predetermined RPM (e.g., RPM3 in the process for forming the agitating water stream in FIG. 6) (T1), after which the motor keeps the predetermined RPM and is constantly driven (T2). In the Off-time section where no current is applied to the motor 32, the RPM of the motor 32 is gradually reduced (T3), thereby completing one cycle where the RPM of the motor is increased and is then reduced.

Here, it is assumed that the driving speed variation of the motor is ideally realized along L1. However, due to the load applied to the motor 32 and the driving time of the motor 32, the motor may not maintain the constant speed section T2. In this case, the RPM of the motor 32 varies along L2 represented by dotted-line.

When forming the agitating water stream, the section where the pulsator 25 rotates by one turn is only hundreds of milliseconds, the motor does not constantly rotate at the predetermined RPM and the RPM of the motor is immediately reduced. Therefore, it should be understood that the graph of FIG. 6 illustrates a process where the RPM of the motor 32 ideally varies in accordance with the pattern of the driving signal having the on-time section and the Off-time section.

When the process for forming the first agitating water stream (S20) in which the net acting ratio is about 1 is performed, the temperature of the IPM driver 36 is gradually increased, after which the process for forming the second agitating water stream (S30) in which the net acting ratio is 0.8 is performed, whereby the temperature of the IPM driver 36 is reduced again.

After the above, the process for forming the first agitating water stream (S40) in which the net acting ratio is about 1 and the process for forming the second agitating water stream (S50) in which the net acting ratio is 0.8 are repeated, thereby completing the process for forming the agitating water stream (S20, S30, S40, and S50).

In the process for forming the agitating water stream (S20, S30, S40, and S50), the pulsator 25 repeatedly rotates in opposite directions at a high RPM (e.g., RPM3 may be set as 800-1100 RPM). At this point, by the strong water stream action, each laundry in the inner tub 24 rotates at a comparatively similar speed. Due to this, a phenomenon where the laundry get tangled.

In order to disentangle the tangle laundry, a process for disentangling the laundry is performed (S60).

In the disentangling process S60, the pulsator alternately rotates clockwise and counterclockwise. At this point, the RPM of the pulsator is lower than that in the agitating water stream forming processes S20, S30, S40, and S50 (i.e., RPM1≤RPM2). Accordingly, water stream that is weaker than that in the agitating water stream forming processes S20, S30, S40, and S50 is formed in the inner tub 24. In addition, a speed difference between the laundry closer to the pulsator 25 and the laundry far from the pulsator 25 is increased and thus the tangled laundry is disentangled.

After the tangled laundry is disentangled through the disentangling process S60, the process for forming the centrifugal circulation water stream is performed (S70). Since the laundry is evenly distributed in the inner tub 24 through the disentangling process S60, the generation of the vibration and noise is reduced in the centrifugal circulation water stream forming process S60. Accordingly, it becomes possible to set the RPM of the inner tub 24 higher.

Meanwhile, in the centrifugal circulation water stream forming process S70, it is preferable to set one cycle (e.g., tens of seconds) where the inner tub 24 continuously rotates in a direction to be greatly longer than the one cycle (e.g., about hundreds of milliseconds) of the agitating water stream forming processes S20, S30, S40, and S50. That is, as shown in FIG. 6, when the centrifugal circulation water stream forming process S70 has a plurality of cycles, the whole performing time of the centrifugal circulation water stream forming process S70 is greatly increased. Therefore, it is more effective to perform the centrifugal circulation water stream forming process S70 prior to the disentangling process S60, thereby more effectively reduce the vibration and noise.

As shown in FIG. 6, the centrifugal circulation water stream forming process S70 may include a plurality of cycles including a cycle for continuously rotating the inner tub 24 clockwise and a cycle for continuously rotating the inner tub 24 counterclockwise. These cycles are repeatedly performed. Alternatively, the centrifugal circulation water stream forming process S70 may include a plurality of cycles including a cycle for continuously rotating the inner tub 24 clockwise, a cycle for stopping the inner tub 24 for a while, and a cycle for continuously rotating the inner tub 24 counterclockwise. These cycles are also repeatedly performed.

Meanwhile, in the centrifugal circulation water stream forming process S70, as shown in FIG. 4, the laundry is adhered to the inner surface of the inner tub 24 by the centrifugal force and thus integrally rotates together with the inner tub 24. Therefore, the movement of the laundry is relatively small and thus the disentangled state of the laundry is maintained.

After the centrifugal circulation water stream forming process S70, a spinning process S80 for removing the water out of the laundry is formed by further increasing the RPM of the inner tub 240 is performed. In the spinning process S80, although not shown in FIG. 6, the RPM of the inner tub 24 may be higher than the RPM3 of the agitating water stream forming process.

The washing method according to an embodiment of the present invention has an advantage in that, since the laundry that is tangled in the agitating water stream forming processes S20, S30, S40, and S50 is disentangled in the disentangling process S60 and the even distribution of the laundry in the inner tub 24 is maintained during the centrifugal circulation forming process S70, the vibration and noise can be reduced in the spinning process S80 as the laundry is evenly distributed in the inner tub 24 even when a special disentangling process is not further performed.

Meanwhile, the net acting ratio of the disentangling process S60 may be differently set from the net acting ratio of the agitating water stream forming processes S20, S30, S40, and S50. That is, the net acting ratio of the disentangling process S60 may be set to be lower than the net acting ratio of the agitating water stream forming processes S20, S30, S40, and S50.

As the net acting ratio of the disentangling process S60 may be set to be lower than the net acting ratio of the agitating water stream forming processes S20, S30, S40, and S50, the IPM driver S36 that is overheated in the agitating water stream forming process S20, S30, S40, and S50 can be effectively cooled and thus the driving time of the motor 32 in the following centrifugal circulation water stream forming process S70 can be prolonged, thereby improving the washing performance.

Figure 8:
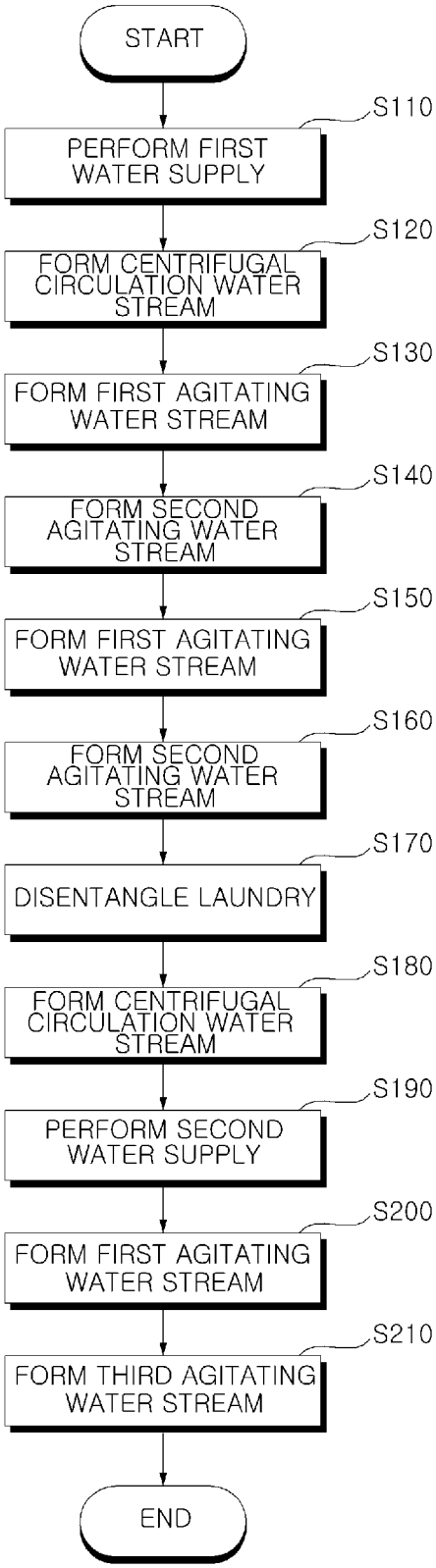
FIG. 8 is a flowchart illustrating a washing method according to another embodiment of the present invention.
Figure 9:
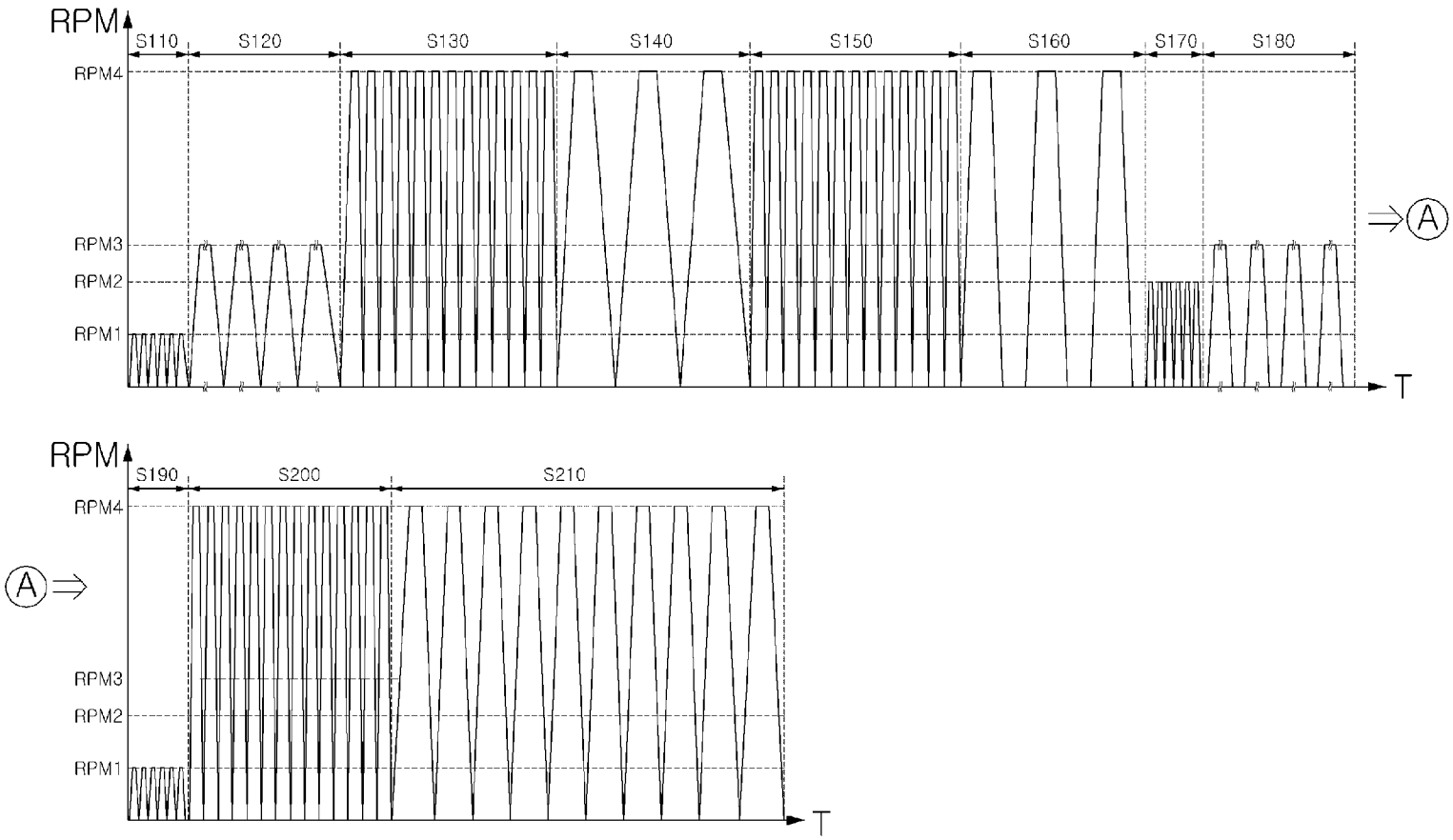
FIG. 9 is a graph illustrating an RPM variation when the washing machine operates in accordance with the washing method illustrated in FIG. 8.

FIG. 8 is a flowchart illustrating a washing method according to another embodiment of the present invention, and FIG. 9 is a graph illustrating an RPM variation when the washing machine operates in accordance with the washing method illustrated in FIG. 8.

Referring to FIGS. 8 and 9, a washing method according to another embodiment of the present invention includes a first water supply process S110 for supplying washing water to the outer and inner tubs 22 and 24, a centrifugal circulation water stream forming process S120 for forming the centrifugal circulation water stream by rotating the inner tub 24, a first agitating water stream forming process S130 that is controlled by a first net acting ratio, a second agitating water stream forming process S140 that is controlled by a second net acting ratio different from the first net acting ratio. These processes are sequentially performed. After these processes are performed, the first agitating water stream forming process S150 ad the second water stream forming process S160 are performed once more, after which a disentangling process S170 and a centrifugal circulation forming process S180 are sequentially performed.

In the first water supply process S110, the washing water is supplied into the outer and inner tubs 22 and 24 by the water supply unit 60. The control unit 55 opens water supply valve 62 so that the water supplied through the water supply passage 61 can be directed into the inner tub 24 via the detergent box 15.

Since the centrifugal circulation water stream forming process S120, the first agitating water stream forming processes S130 and S150, the second agitating water stream forming processes S140 and S160, and the disentangling process S170 are identical to those of the foregoing embodiment, detailed description thereof will be omitted herein.

In the agitating water stream forming processes S130, S140, S150, and S160, the water and detergent are uniformed mixed by the agitating water stream that is generated by the rotation of the pulsator 25 and the dirt of the laundry is removed by the frictional action between the pulsator 25 and the laundry and the chemical action of the detergent.

After the centrifugal circulation water stream process S180, the second water supply process S190 for additionally supplying the water to the outer and inner tubs 22 and 24 is performed. Like in the first water supply process S110, the water supply valve 62 is opened by the control unit 55 and the washing water is additionally supplied. At this point, no detergent remains in the detergent box 15 by the water supplied in the first water supply process S110. Therefore, when the second water supply process S190 is performed, the detergent concentration of the washing water in the outer and inner tubs 22 and 24 is lowered. Hereinafter, the process after the second water supply process S190 will be referred to as a dilution washing process. On the contrary, the process after the first water supply process S110 and before the second water supply process S190 will be referred to as a high concentration washing process.

In the dilution washing process, first and third agitating water stream forming processes S200 and S210 are performed. The net acting ratio of the motor 32 in the third agitating water stream forming process S210 may be different from those of the motor 32 in the first agitating water stream forming processes S130, S150, and S200 and the second agitating water stream forming processes S140 and S160.

Like in the foregoing embodiment, when the net acting ratio (first net acting ratio) in the first agitating water stream forming processes S130, S150, and S200 is 1 and the net acting ratio (second net acting ratio) in the second agitating water stream forming process S140 and S160 is 0.8, a third net acting ratio may be set to be less than the first net acting ratio but greater than the second net acting ratio. Hereinafter, it is assumed that the third net acting ratio is 0.9.

In the high concentration washing process, the first agitating water stream forming process S130 is performed with the net acting ratio of 1, after which, in order to lower the temperature of the IPM driver 36 that is heated, the second agitating water stream forming process S140 is performed with the net acting ratio of 0.8. After this, the first and second agitating water stream forming processes S150 and S160 are repeated. Accordingly, by performing the second agitating water stream forming process S140 driven with the net acting ratio of 0.8 between the first agitating water stream forming processes S130 and S150 driven with the net acting ratio of 1, the temperature control of the IPM driver 26 and the sufficient washing performance can be attained.

Meanwhile, in the dilution washing process, after the first agitating water stream forming process S200 driven with the net acting ratio of 1 is performed, a third agitating water stream forming process S210 driven with the net acting ratio of 0.9 is performed. In this third agitating water stream forming process S210, although the washing performance may be lower than that in the first agitating water stream forming processes S130 and S150, the heat generation of the IPM driver 36 can be lowered. In addition, although the heat generation of the IPM driver 36 in the third agitating water stream forming process S210 is greater than that of the IPM driver 36 in the second agitating water stream forming processes S140 and S160, the washing performance in the third agitating water stream forming process S210 may be higher than that in the second agitating water stream forming processes S140 and 160.

One of the reasons for performing the third agitating water stream forming process S210 in the dilution washing process is for not only soaking the laundry in the washing water for a long time by properly controlling the heat generation of the IPM driver 36 but also attaining a proper washing performance that is worse than the first agitating water stream forming processes S130 and S150 but better than the second agitating water stream forming processes S140 and S160.

The washing method of the present invention has an advantage of reducing the vibration and noise that are generated during the operation of the washing machine.

In addition, the washing method of the present invention has an advantage of effectively controlling the heat generation of the IPM driver.

Further, the washing machine of the present invention has an advantage of securing the operational accuracy and stability of the washing machine.

Furthermore, the washing method of the present invention has an advantage of improving the washing performance by treating the laundry using the agitating water stream and the centrifugal circulation water stream.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A washing method of a washing machine comprising an outer tub for receiving washing water, an inner tub rotatably provided in the outer tub to receive laundry, a pulsator rotatably provided in the inner tub, and a motor providing driving force to rotate the inner tub and the pulsator, the washing method comprising:

supplying detergent dissolved water into the outer tub to a predetermined level;

performing a high concentration washing process comprising:

forming a first centrifugal circulation water stream by rotating the inner tub at a speed set to cause water stream to rise along a space between the outer and inner tubs and fall into the inner tub at the predetermined level;

forming an agitating water stream by rotating the pulsator; and forming a second centrifugal circulation water stream by rotating the inner tub, wherein the forming of the agitating water stream comprises:

forming a first agitating water stream by controlling the motor with a first net acting ratio; and forming a second agitating water stream by controlling the motor with a second net acting ratio lower than the first net acting ratio, following the forming of the first agitating water stream, wherein the forming of the agitating water stream is finished with the forming of the second agitating water stream; and additionally supplying washing water into the outer tub; and performing a dilution washing process, the dilution washing process comprising:

forming a third agitating water stream by rotating the pulsator such that the washing water in the inner tub is agitated, wherein a third net acting ratio used in the forming of the third agitating water stream is different from the first and second net acting ratios, wherein the high concentration washing process further comprises, after the forming of the agitating water stream, disentangling the laundry by alternately rotating the pulsator clockwise and counterclockwise so that the laundry in the inner tub can be evenly distributed, and wherein a fourth net acting ratio during the disentangling of the laundry is set to be lower than the first, second, and third net acting ratios, wherein the first, second, third, and fourth net acting ratios are each characterized by a consecutively repeating on-time/off-time control pattern of the motor.

2. The washing method of claim 1, wherein the forming of the second agitating water stream is repeatedly performed.

3. The washing method of claim 1, wherein the first net acting ratio is 1.

4. The washing method of claim 2, wherein a RPM of the motor in the disentangling of the laundry is lower than that of the motor in the forming of the agitating water stream.

5. The washing method of claim 4, wherein forming the second centrifugal circulation water stream follows the disentangling of the laundry.

6. The washing method of claim 1, wherein the dilution washing process further comprises again forming of the first agitating water stream, wherein the forming of the third agitating water stream follows the again forming of the first agitating water stream.

7. The washing method of claim 5, wherein the third net acting ratio is less than the first net acting ratio.

8. The washing method of claim 7, wherein the third net acting ratio is a value between the first and second net acting ratios.

* * * * *